US007987799B2

(12) United States Patent
Lange et al.

(10) Patent No.: US 7,987,799 B2
(45) Date of Patent: Aug. 2, 2011

(54) ADJUSTABLE SHELF

(75) Inventors: Timothy Gordon Lange, Champlin, MN (US); Robert M. Kalstabakken, Cambridge, MN (US); Brian L. Mordick, Shoreview, MN (US); Jeremy Lee Fink, Anoka, MN (US); Trent T. Jones, White Bear Lake, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 0 days.

(21) Appl. No.: 11/761,931

(22) Filed: Jun. 12, 2007

(65) Prior Publication Data

US 2008/0308515 A1 Dec. 18, 2008

(51) Int. Cl.
*A47B 11/00* (2006.01)

(52) U.S. Cl. ..... 108/102; 108/50.02; 108/137; 108/143; 312/223.6

(58) Field of Classification Search ..... 108/102, 108/107, 190, 137, 143, 50.02, 50.01, 23, 108/147.21, 192, 193, 110, 147.15, 147.12; 211/153, 90.02, 134, 135; 248/234, 245; 312/223.3, 223.6, 223.1
See application file for complete search history.

(56) References Cited

U.S. PATENT DOCUMENTS 498,563 A * 5/1893 Montgillion ..... 52/317
527,589 A * 10/1894 Bristol ..... 312/223.6
1,521,902 A * 1/1925 Mott ..... 108/42
1,872,740 A * 8/1932 James ..... 108/149
1,963,427 A * 6/1934 Tyler ..... 108/110
2,441,721 A * 5/1948 Schroeder ..... 108/30
3,294,250 A * 12/1966 Evans ..... 108/147.15
3,456,970 A * 7/1969 Sunasky ..... 108/110
RE27,160 E * 8/1971 Ferdinand et al. ..... 108/147.12
3,648,626 A * 3/1972 Schuster ..... 108/42
4,155,312 A * 5/1979 Thorkildson ..... 108/137
4,500,146 A * 2/1985 Peterson ..... 108/107
4,607,576 A * 8/1986 Kranjec ..... 108/186
4,679,867 A * 7/1987 Heldenbrand et al. ..... 312/223.6
4,681,378 A * 7/1987 Hellman, III ..... 312/223.6
4,713,949 A * 12/1987 Wilcox ..... 68/235 R
4,850,657 A * 7/1989 Placke et al. ..... 312/223.6
5,016,947 A * 5/1991 Hsu et al. ..... 312/223.6
5,137,160 A * 8/1992 Santucci ..... 211/153
5,421,646 A * 6/1995 McNamara et al. ..... 108/102
5,429,431 A * 7/1995 Olson et al. ..... 312/223.6
5,645,182 A 7/1997 Miller et al.
6,019,321 A * 2/2000 Carlson et al. ..... 312/223.6
6,088,239 A * 7/2000 Zeiss ..... 312/223.6
D444,656 S * 7/2001 West ..... D6/511
6,336,691 B1 * 1/2002 Maroney et al. ..... 361/725
6,523,795 B2 * 2/2003 Gutgsell et al. ..... 108/50.02
6,647,900 B1 * 11/2003 Kopish ..... 108/50.02

(Continued)

OTHER PUBLICATIONS

Parts Catalog—Shelves, *Hammond Manufacturing Co., Inc.*, Copyright 1998-2006, Hammond Manufacturing Co., Inc. (undated; published at least before Jun. 12, 2007), 10 pages.

*Primary Examiner* — Jose V Chen
(74) *Attorney, Agent, or Firm* — Quarles & Brady, LLP

(57) ABSTRACT

A shelf includes a first shelf section and a second shelf section that slidingly fits with the first shelf section such that the first shelf section and second shelf section are configured to form a shelf surface having a usable shelf surface area that is variable.

3 Claims, 8 Drawing Sheets

U.S. PATENT DOCUMENTS

D497,738 S 11/2004 Sparkowski
6,877,826 B2 * 4/2005 Wood et al. ..... 108/110
6,990,909 B2 * 1/2006 Gosling et al. ..... 108/50.02
7,007,614 B2 * 3/2006 Gaunt et al. ..... 108/102
7,055,833 B2 * 6/2006 Wixted et al. ..... 312/223.6

* cited by examiner

ADJUSTABLE SHELF

FIELD OF THE INVENTION

This invention relates to the field of shelves for enclosure racks, and more specifically to an adjustable shelf.

BACKGROUND

Enclosure racks can include two or four vertical posts for mounting equipment. Shelves for holding equipment can also be mounted to the posts. For example, a rack can include four corner posts and the shelf is mounted to these posts. However, the depth of racks used in the industry can vary according to the equipment to be stored thereon.

SUMMARY

A shelf includes a first shelf section and a second shelf section that slidingly fits with the first shelf section such that the first shelf section and second shelf section are configured to form a shelf surface having a usable shelf surface area that is variable.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
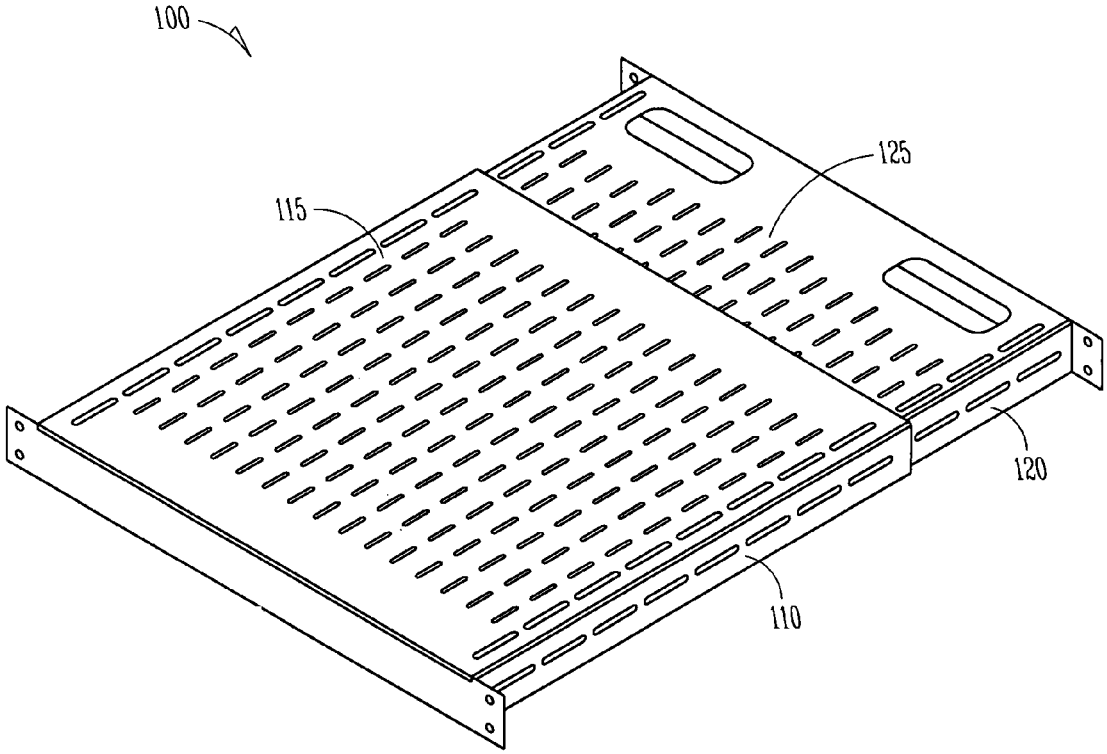
FIG. 1 shows a perspective view of an adjustable shelf according to one embodiment.

FIG. 1 shows a perspective view of an adjustable shelf 100, according to one embodiment. Adjustable shelf 100 is usable with an enclosure rack and is depth-adjustable so as to provide a variable usable surface area for various racks having various depths. Adjustable shelf 100 generally includes a first shelf section, such as front shelf section 110 having a planar upper surface 115, and a second shelf section, such as back shelf section 120 having a planar upper surface 125. Front shelf section 110 and back shelf section 120 having a sliding fit. Front shelf section 110 and back shelf section 120 are configured such that they are telescoped together so as to be adjustable such that more or less of back shelf section upper surface 125 is exposed. Upper surface 115 of front shelf section 110 and the exposed portion of upper surface 125 of back shelf section 120 define an overall usable planar surface area. Thus, by sliding back shelf section 120 relative to front shelf section 110, the usable surface area has a variable surface area. By usable surface, this document means that there is a planar upper surface defined by planar upper surface 115 and the exposed portion of planar upper surface 125 for support any equipment on the shelf. Thus, the adjustable shelf 100 becomes a full-length shelf for any depth of enclosure.

Figure 2:
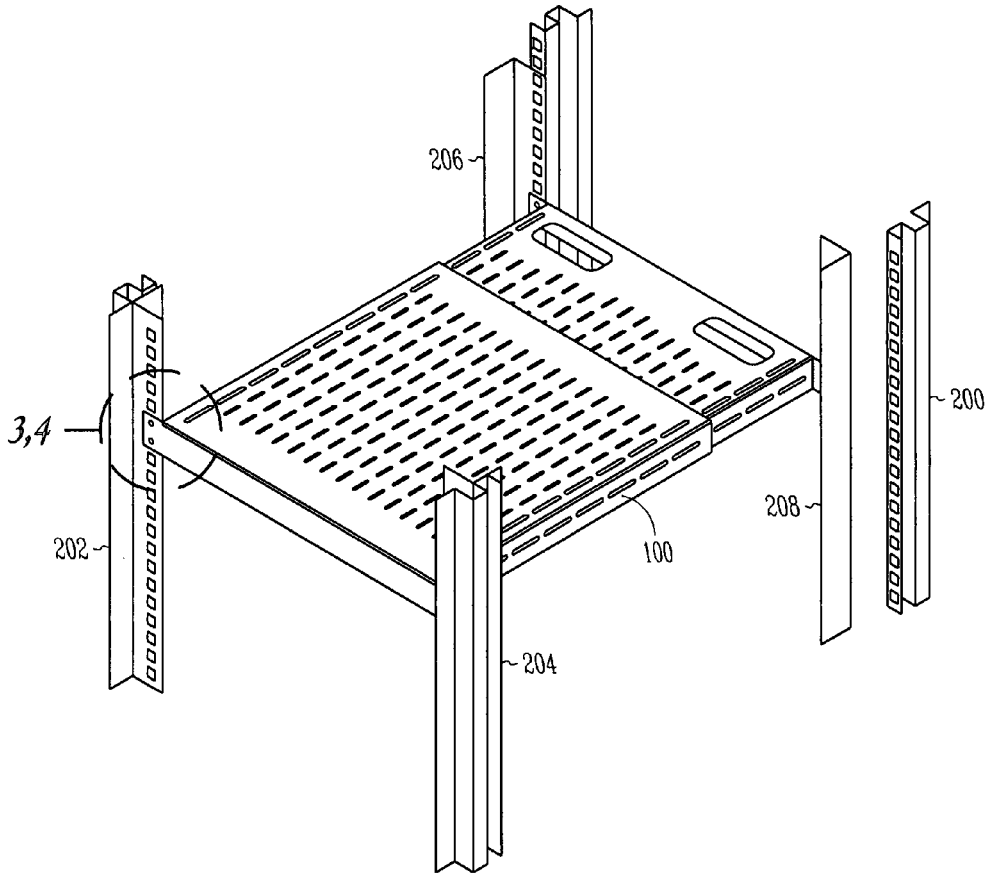
FIG. 2 shows a perspective view of the adjustable shelf of Figure one being mounted to a rack.

FIG. 2 shows a perspective view of adjustable shelf 100, mounted to a four-post rack 200. Four-post rack 200 includes four posts 202, 204, 206, and 208 for mounting the adjustable shelf 100.

Figure 3:
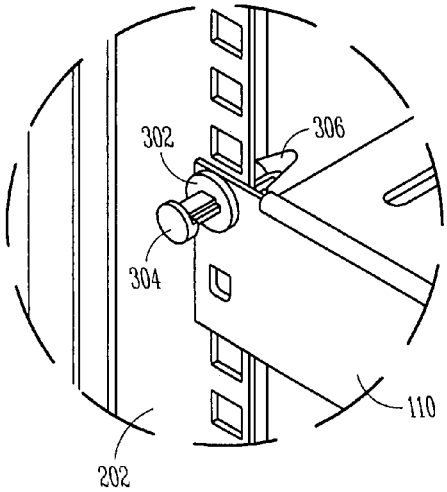
FIG. 3 shows a detail of FIG. 2.
Figure 4:
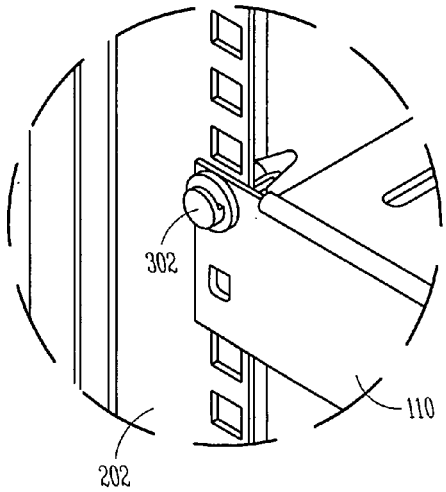
FIG. 4 shows another detail of FIG. 2.
Figure 11:
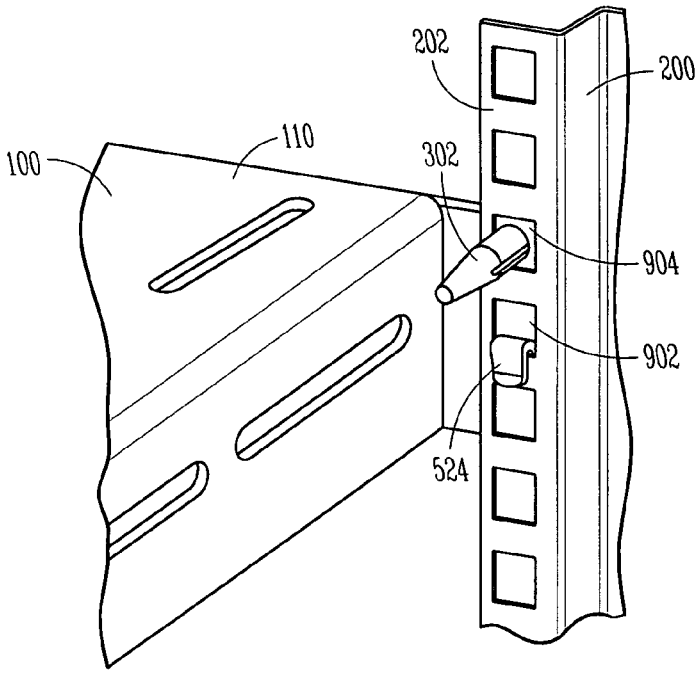
FIG. 11 shows a rear perspective view of an adjustable shelf mounted to a rack, in accordance with one embodiment.

FIGS. 3, 4, and 11 show a detail of front section 110 of adjustable shelf 100 being mounted to front post 202, in accordance with one embodiment. Front shelf section 110 is mounted to the rack so that a tab 524 on the front shelf section is mounted within a hole 902 on rack 200. The shelf is pushed down to clip tab 524 into position. All the corners of shelf 100 include tabs, such as tab 524, that can be clipped into place on the rack. This mounting system allows the shelf to be mounted to the rack tool-lessly.

In some embodiments a fastener, such as an expandable fastener 302, is then positioned through a hole of the front shelf section 110 and through an adjacent hole 904 of the rack. In one embodiment, expandable fastener 302 includes an inner member 304 that is then pushed into an outer portion 306 to tighten the fastener 302 in position and mount shelf 100 to rack 200. Back shelf section 120 is mounted to the rear posts 206, 208 of rack 200 in a similar manner. Fasteners 302 can also be used without tools further allowing the shelf to be mounted to the rack tool-lessly.

Figure 5:
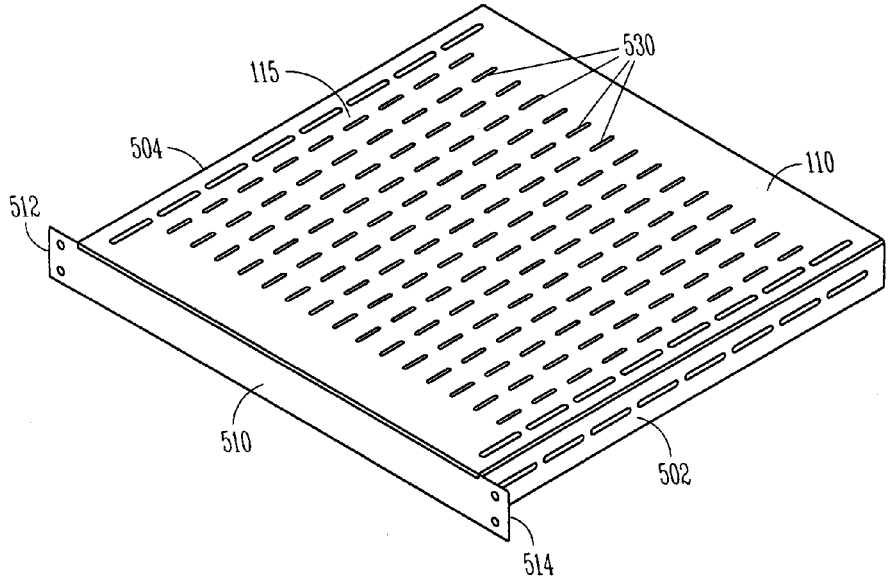
FIG. 5 shows a perspective view of a front shelf section of an adjustable shelf, in accordance with one embodiment.
Figure 6A:
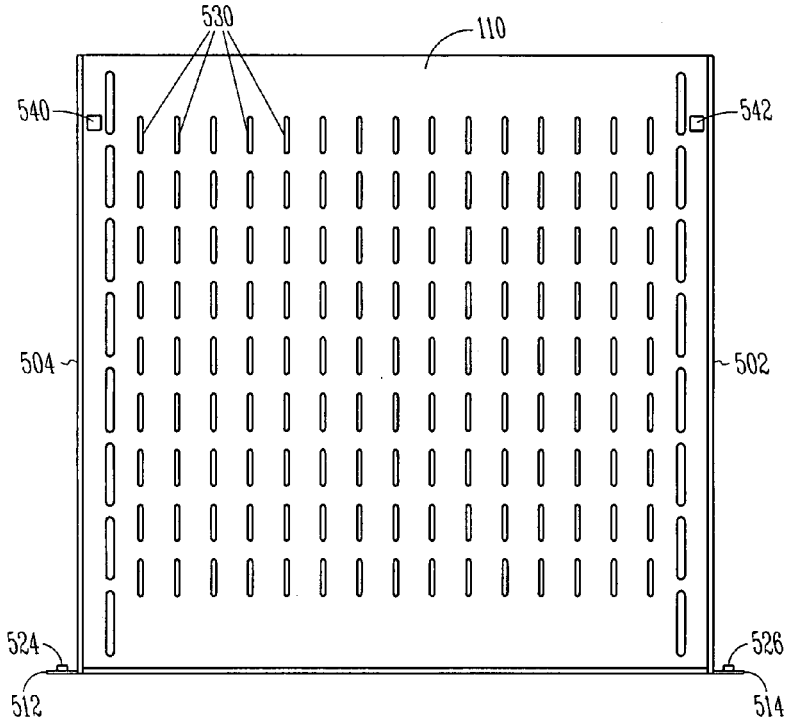
FIG. 6A shows a top view of the front shelf section of FIG. 5.
Figure 6B:
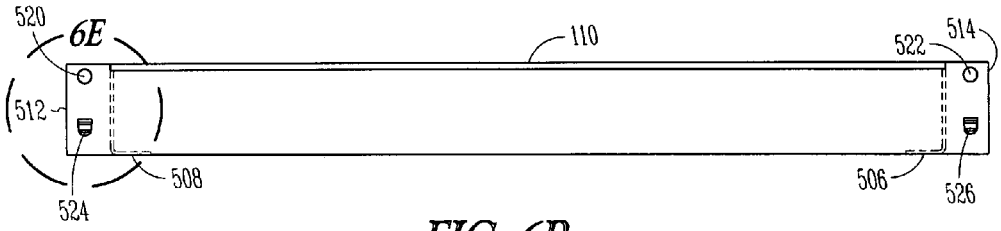
FIG. 6B shows a front view of the front shelf section of FIG. 5.
Figure 6C:
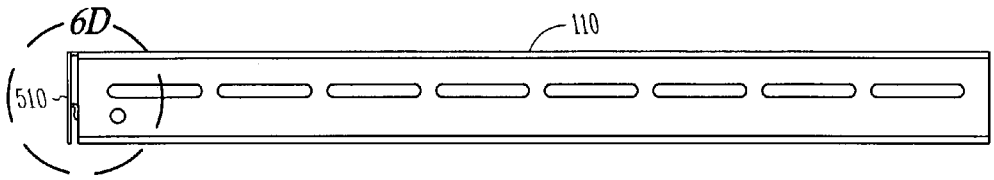
FIG. 6C shows a side view of the front shelf section of FIG. 5.
Figure 6D:
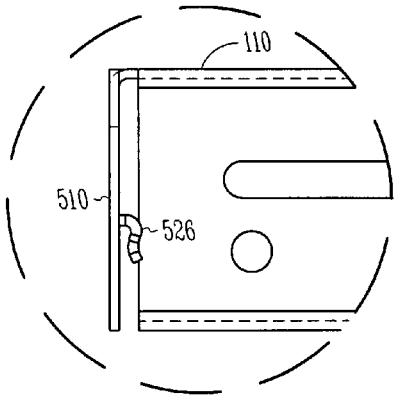
FIG. 6D shows a detail of the front shelf section of FIG. 5.
Figure 6E:
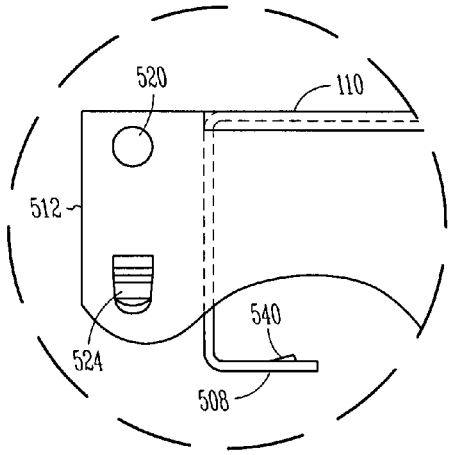
FIG. 6E shows a detail of the front shelf section of FIG. 5.

FIG. 5 shows a perspective view of front shelf section 110, in accordance with one embodiment. FIG. 6A shows a top view of front shelf section 110, FIG. 6B shows a front view of front shelf section 110, FIG. 6C shows a side view of front shelf section 110, FIG. 6D shows a detail of front shelf section 110, and FIG. 6E shows a detail of front shelf section 110.

Front shelf section 110 includes top planar surface 115 with a plurality of slots 530 arranged to provide ventilation. Side walls 502 and 504 extend down from top planar surface 115. Bottom walls 506 and 508 extend inward from the bottom of side walls 502 and 504, respectively. A front wall 510 also extends down from the front side of top planar surface 115. Front wall 510 is dimensioned such that a first end 512 of the front wall 510 extends outward from the front shelf section 110 and a second end 514 of the front wall 510 also extends outward from front shelf section 110. Each of the first end 512 and the second end 514 of front wall 510 include mounting holes 520 and 522, respectively, and mounting tabs 524 and 526, respectively. As described above, mounting tabs 524, 526 engage and mount to the rack 200, and holes 520 and 522 provide a mounting for a fastener.

Figure 12:
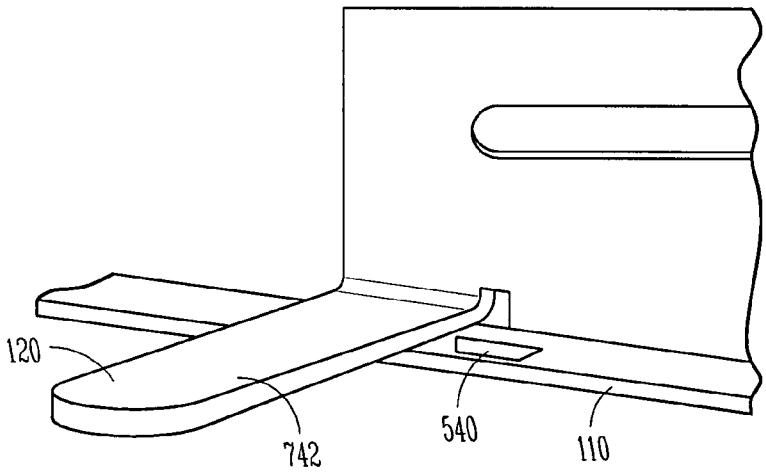
FIG. 12 shows a perspective view of an adjustable shelf, in accordance with one embodiment.

Each of bottom walls 506 and 508 include a bent metal tab 540, 542 located near the back ends of bottom walls 506 and 508. As shown in FIG. 12, tabs 540, 542 provide a stop when the front shelf section 110 and back shelf section 120 are at their full extension.

Figure 7:
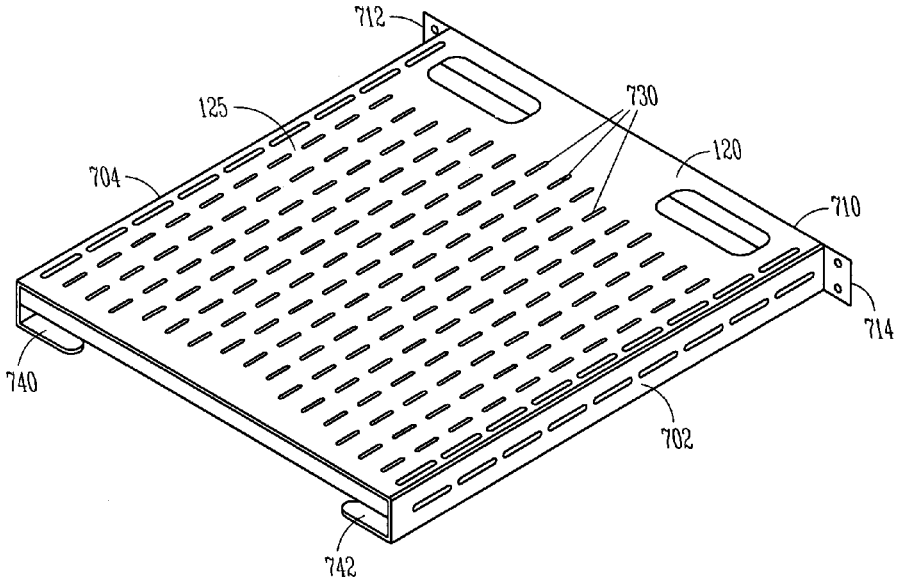
FIG. 7 shows a perspective view of a back shelf section of an adjustable shelf, in accordance with one embodiment.
Figure 8A:
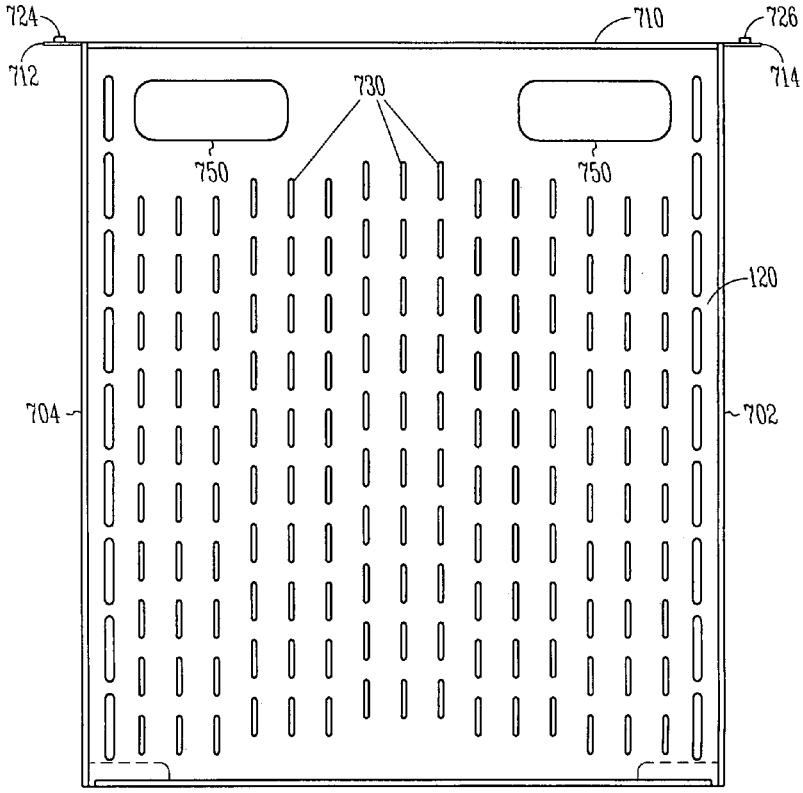
FIG. 8A shows a top view of the back shelf section of FIG. 7.
Figure 8B:
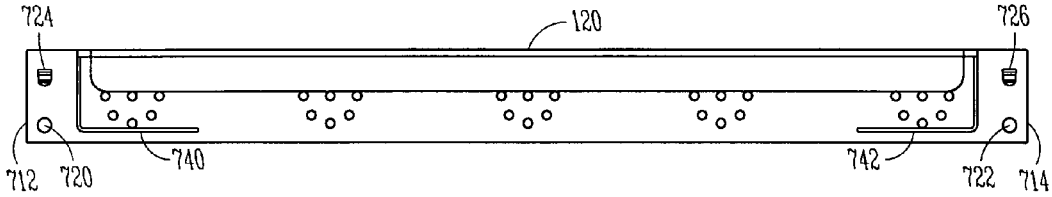
FIG. 8B shows a front view of the back shelf section of FIG. 7.
Figure 8C:
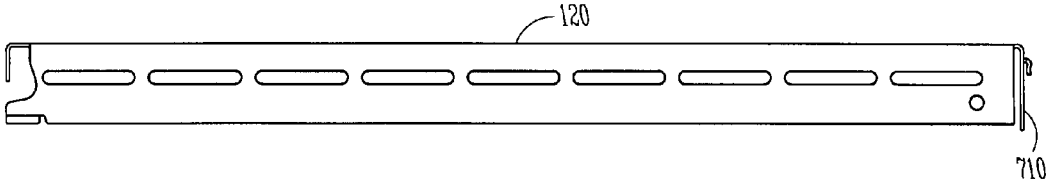
FIG. 8C shows a side view of the back shelf section of FIG. 7.

FIG. 7 shows a perspective view of back shelf section 120, in accordance with one embodiment, FIG. 8A shows a top view of back shelf section 120, FIG. 8B shows a front view of back shelf section 120, FIG. 8C shows a side view of back shelf section 120.

Back shelf section 120 includes top planar surface 125 with side walls 702 and 704 extending down from top planar surface 125. In use, side walls 702 and 704 rest on bottom walls 506, 508 of front shelf section 110 (FIG. 6B). A back wall 710 also extends down from top planar surface 125. Back wall 710 is dimensioned such that a first end 712 of the back wall 710 extends outward from the back shelf section 120 and a second end 714 of the back wall 710 also extends outward from back shelf section 120. Each of the first end 712 and the second end 714 of front wall 710 include mounting holes 720 and 722, respectively, and mounting tabs 724 and 726, respectively. As described above, mounting tabs 724, 726 engage and mount to the rack 200, and holes 720 and 722 provide a mounting for a fastener.

Top planar surface 125 includes a plurality of ventilation slots 730 and one or more wiring holes 750. In one embodiment, slots 730 have a staggered slot pattern. This staggered pattern of slots 730 allows for at least some of slots 730 or 530 of first shelf section 110 (FIG. 5) to remain unblocked when the shelf section 110 and 120 are pushed together so as to maintain airflow. This can also be seen in FIG. 9 which shows how the staggered pattern of slots 730 prevents at least some of slots 530 from being blocked. In some embodiments, the front section 110 can include staggered slots and the back section 120 can include standard slots.

Each of side walls 704 and 702 include a stop portion 740, 742 located near the front ends of the walls 704 and 702. Referring again to FIG. 12, stop portions 740, 742 provide a stop against tabs 540, 542 when the front shelf section 110 and back shelf section 120 are at their full extension.

Figure 9:
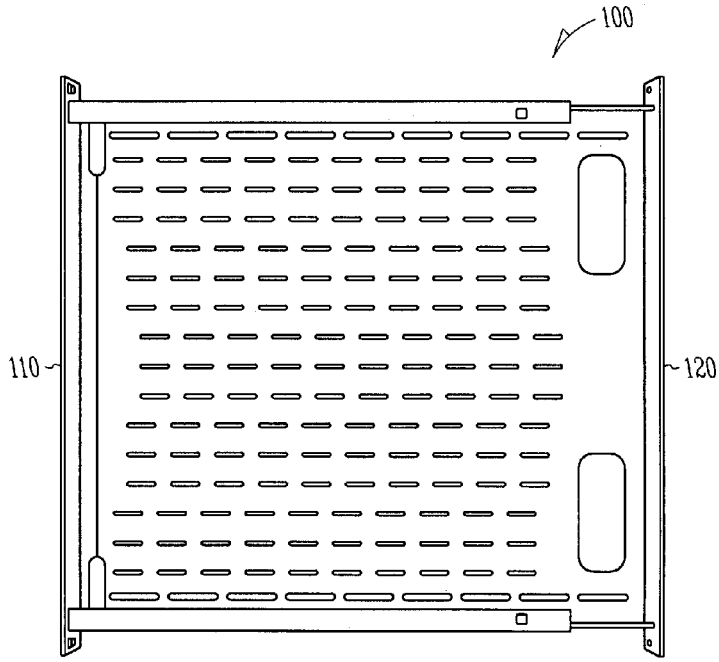
FIG. 9 shows a bottom view of an adjustable shelf, in accordance with one embodiment.
Figure 10:
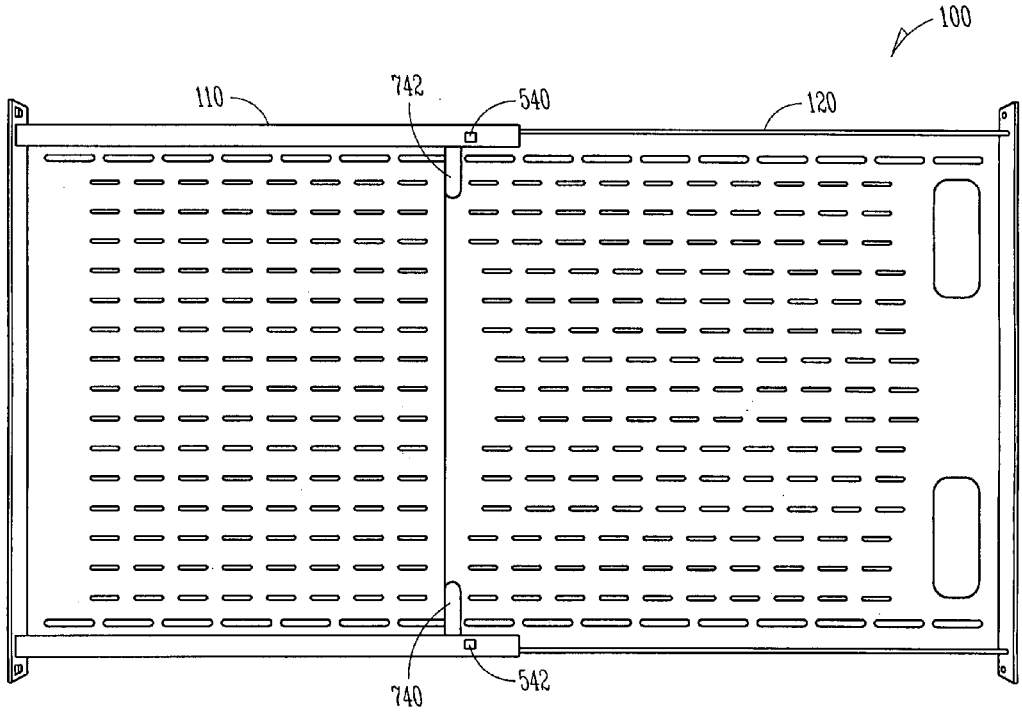
FIG. 10 shows a bottom view of an adjustable shelf, in accordance with one embodiment.

FIGS. 9 and 10 show a bottom view of adjustable shelf 100, in accordance with one embodiment. FIG. 9 shows shelf 100 with first shelf section 110 and second shelf section 120 pushed completely together and FIG. 10 shows shelf sections 110 and 120 when fully extended. In use, the installer adjusts the shelves to the needed depth and then mounts the shelf sections 110 and 120 to the rack as discussed above. The usable surface area of the shelf 100 is continuously variable by sliding the two sections to the desired size, and not discrete predetermined sizes.

In other embodiments, front section 110 and back section 120 can be dimensioned such that front section 110 fits within back section 120.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A shelf for an electrical enclosure, the electrical enclosure including a four-post rack, the shelf comprising:

a first shelf section including a first top planar surface, a front wall, a first side wall, a second side wall, a first bottom wall extending inward from the first side wall toward the second side wall, and a second bottom wall extending inward from the second side wall toward the first side wall, the first bottom wall including a first bent tab, and the second bottom wall including a second bent tab, the front wall including a first end and a second end, the first end and the second end each including a mounting tab that clips onto a post of the four-post rack and a mounting hole adapted to receive an expandable fastener in order to attach the first shelf section to the four-post rack without using any tools;

a second shelf section including a second top planar surface, a third side wall, and fourth side wall, the third side wall including a first stop portion to engage the first bent tab and the fourth side wall including a second stop portion to engage the second bent tab in order to define a full extension position of the first shelf section with respect to the second shelf section;

the second shelf section slidingly engaging the first shelf section such that the first shelf section and the second shelf section are configured to form a shelf surface having a usable shelf surface area that is variable; and a wiring hole positioned through the second top planar surface, the second top planar surface being longer than the first top planar surface in order to prevent the first top planar surface from covering any portion of the wiring hole so that wires can be routed through the shelf within the electrical enclosure.

2. The shelf of claim 1, wherein the first shelf section and the second shelf section are configured to be telescoping such that one fits within the other.

3. The shelf of claim 1, wherein the first shelf section includes a plurality of ventilation slots and the second shelf section includes a plurality of ventilation slots, and wherein the plurality of ventilation slots on at least one of the first shelf section and the second shelf section have a staggered pattern relative to the plurality of ventilation slots on the other shelf section.

* * * * *